US007730753B2

(12) United States Patent
Krajewski et al.

(10) Patent No.: US 7,730,753 B2
(45) Date of Patent: Jun. 8, 2010

(54) LUBRICANT FOR ELEVATED TEMPERATURE FORMING

(75) Inventors: Paul E. Krajewski, Sterling Heights, MI (US); Yang T. Cheng, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 343 days.

(21) Appl. No.: 11/671,495

(22) Filed: Feb. 6, 2007

(65) Prior Publication Data

US 2008/0185079 A1 Aug. 7, 2008

(51) Int. Cl.
*B21D 22/00* (2006.01)
*C21D 1/68* (2006.01)
*B22C 3/00* (2006.01)

(52) U.S. Cl. ..... 72/42; 72/39; 72/41; 72/43; 72/46; 148/537; 148/696; 148/703; 148/708; 508/154; 508/155

(58) Field of Classification Search ..... 508/155
See application file for complete search history.

(56) References Cited

U.S. PATENT DOCUMENTS 3,744,548 A * 7/1973 Ikeda et al. ..... 164/97
3,909,424 A * 9/1975 Clark ..... 508/121
5,819,572 A 10/1998 Krajewski
5,921,126 A 7/1999 Miller
6,253,588 B1 7/2001 Rashid et al.
6,330,818 B1 * 12/2001 Jain ..... 72/42
6,655,181 B2 12/2003 Morales

FOREIGN PATENT DOCUMENTS

JP 9157682 6/1997
JP 2006-051508 2/2006

OTHER PUBLICATIONS

International Search Report and Written Opinion for PCT/US2008/053010 dated Jun. 26, 2008.

* cited by examiner

*Primary Examiner*—Melvin C Mayes
*Assistant Examiner*—Colin W Slifka
(74) *Attorney, Agent, or Firm*—Reising Ethington P.C.

(57) ABSTRACT

The hot stretch forming of sheet metal alloys, such as highly deformable aluminum alloy materials, is improved by using a lubricant comprising bismuth between the forming tool and the engaged surface of the sheet metal. A precursor of bismuth, such as bismuth subsalicylate, may be dispersed in a liquid and applied to the sheet metal before the sheet is heated to its forming temperature. Other lubricants such as boron nitride may be combined with the bismuth precursor. The precursor compound is decomposed to bismuth (or bismuth and carbon in the case of bismuth subsalicylate) which lubricates contact between the surface(s) of the sheet and the forming tool during forming and removal of the formed part from the tool.

8 Claims, 2 Drawing Sheets

LUBRICANT FOR ELEVATED TEMPERATURE FORMING

TECHNICAL FIELD

This invention generally relates to lubrication of sheet metal forming processes conducted at elevated temperatures. More specifically, this invention pertains to the use of bismuth in a lubricant coating between a sheet metal workpiece and a forming tool when the tool and workpiece are at temperatures of, for example, about 200° C. or higher.

BACKGROUND OF THE INVENTION

Sheet metal workpieces of an alloy of suitable formability may be stretched and/or drawn against or over a forming tool surface at an elevated temperature to form a shape of complex deformation. For example, automotive body panels are being formed using sheet metal blanks of fine-grained aluminum alloy 5083.

In a high temperature sheet metal forming process, a formable metal material capable of high ductility under proper conditions is deformed against a surface of a forming tool. Fine-grain aluminum alloys have been known to achieve elongations of up to 1200% when heated to a temperature in the range of 400° C. to 550° C. and subjected to suitable strain rates. Similarly, fine grain titanium alloys have been known to achieve elongations of up to 1100% when heated to a temperature in the range of 815° C. to 1000° C.

Examples of a high temperature sheet metal forming processes include superplastic forming (SPF), quick plastic forming (QPF), and warm forming. SPF and QPF processes are examples of hot blow forming (also called hot stretch forming) processes used extensively with aluminum alloys in the manufacture of automobile components such as inner and outer lift gate panels, inner and outer door panels, deck lid panels, and the like. The sheet metal workpiece is positioned with one side lying close to the hot forming surface of a heated forming tool. The metal sheet is often preheated to its forming temperature so that both the workpiece and forming surface are at forming temperatures. A pressurized fluid, such as air is applied to the other side of the sheet forcing and stretching it into conformance with the tool surface, A common feature of these sheet metal parts is that they often require extensive localized deformation of the sheet metal to form a desired panel shape. In the case of automobile body panels, the parts may be formed in a single hot stretch forming stage or multiple forming steps may be used.

There is aggressive contact between the contacting side of the hot sheet metal and hot forming tool surface as the metal is deformed, and lubrication between the contacting surfaces is normally required. Sliding contact between the deforming metal workpiece and the forming tool often leads to problems associated with friction and adhesion. Adhesion may lead to galling patterns appearing on the finished workpiece surfaces, and forcible separation of the workpiece from the forming tool can distort the deformed metal workpiece beyond its allowable dimensions. Moreover, friction that occurs while the metal sheet is contacting the forming surface of the forming tool can lead to scratches, marks, and excessive roughness on the surface of the deformed metal workpiece, which may prevent the workpiece from meeting surface appearance requirements. Furthermore, this friction may affect the forming tool's forming surface, which may adversely affect all subsequently deformed metal workpieces by continuously reproducing undesirable abrasions.

Several lubricant coating materials have been developed to minimize friction and adhesion between the metal sheet and the forming tool. Boron nitride and graphite have been utilized for such purposes. Magnesium hydroxide [$Mg(OH)_2$] and mixtures of $Mg(OH)_2$ and boron nitride (BN) are also used. These materials have been used in the hot stretch forming of sheet metal blanks of AA5083 into body panels. Milk of magnesia may supply the requisite $Mg(OH)_2$. MgO is also used as a precursor to $Mg(OH)_2$.

Forming tool coatings have also been used. For example, a suitable coating may consist essentially of either a tungsten carbide cermet or a chromium carbide cermet having a particle size not more than 0.1 micrometers.

Still, there is a need for other lubricants for elevated temperature sheet metal forming, especially where light weight metal alloys such as aluminum alloys are formed.

SUMMARY OF THE INVENTION

Bismuth is provided as a lubricating medium between the contacting surfaces of the hot sheet metal workpiece and the hot surface of the forming tool. Depending on the specific workpiece material and forming process, forming temperatures are typically at least 200° C. and may be 400° C. or higher. Bismuth may be used alone but preferably it is used in combination with another lubricant such as boron nitride.

The practice of the invention will be illustrated in the hot stretch forming of aluminum alloy sheet materials against forming surfaces such as a tool steel composition. But it is to be understood that bismuth may also be used in the elevated temperature forming of other sheet metal materials. When bismuth is used in the hot stretch forming of aluminum alloys, it is preferred that it be used in a mixture with boron nitride.

Typically, a high volume manufacturing process will start with a roll of the sheet material which has been formed by a sequence of hot rolling and cold rolling steps to achieve a desired sheet metal thickness and microstructure. The sheet material is unrolled and blanks cut from the sheet having a plan view shape for forming of a body panel or the like. Lubrication material is suitably applied as a dry adherent film to either the unrolled sheet or to blanks cut from it. The lubricant is often applied at ambient temperatures before the blank is heated to its forming temperature.

When the hot stretch forming process is repeatedly performed on a continuous series of sheet metal blanks, the forming tool will often be maintained at its hot forming temperature. This is typically accomplished using suitably controlled electrical resistance heating elements in the forming tool and by insulating the tool from the press members that carry and actuate it. Lubricant could be applied periodically to the hot tool, but it is usually easier and preferred to lubricate the sheet metal blank before it is heated to its forming temperature.

Bismuth is preferably used in the form of a precursor compound for application to the sheet metal. For example, bismuth subsalicylate ($HOC_6H_4COOBiO$) is a readily available form of bismuth that is made commercially for antacid applications and the like. Bismuth subsalicylate is easily mixed (if desired) with other lubricant powders and formulated for application to a sheet metal surface. Bismuth subsalicylate may be suspended in water or other liquid medium that will evaporate at either ambient or elevated temperatures. The liquid suspension may be sprayed onto at least one of the surface of the metal sheet or the surface of the forming tool, or it may be applied by a roller or by rubbing with an absorbent applicator, such as a sponge. Heating of the sheet metal blank to its forming temperature will evaporate any remaining liquid and commence decomposition of the bismuth subsalicylate into bismuth and graphitized carbon. The remaining bismuth and graphitized carbon are present in a filmy residue that provides a suitable lubricious barrier between the surface of the metal sheet and the surface of the forming tool.

In addition to bismuth, the lubricant may also comprise another lubricating material such as boron nitride. As is known, boron nitride is stable at elevated temperatures and, when present in a graphite-like allotrope known as hexagonal boron nitride, provides a quite low coefficient of friction surface on a tool or workpiece. Thus, the lubrication properties of boron nitride (or the like) complement the soft barrier characteristics of bismuth or bismuth and graphitized carbon. Bismuth may be expected to be a liquid at forming pressures and forming temperatures which are typically in excess of, for example, 400° C.

One or both surfaces of the blank may be coated depending on whether one side of the blank is engaged by a forming tool in a single-stage operation, or first one side and then the other side are engaged by forming tools in a two-stage forming operation. Lubricant may be applied generally uniformly over the forming surface or the lubricant may be applied in greater amounts in regions of high deformation or tool surface contact. Similarly, different lubricant formulations may be applied over different regions of the workpiece surface depending upon local lubrication needs.

Other exemplary embodiments of the disclosure will become apparent from the detailed description. It should be understood that the detailed description and specific examples, while indicating the exemplary embodiments of the disclosure, are intended for illustration purposes only and not intended to limit the scope of the invention.

BRIEF DESCRIPTION OF THE DRAWINGS

The disclosure will now be described, by way of example, and not limitation, with reference to the accompanying drawings. The following is a brief description of the drawings.

DESCRIPTION OF PREFERRED EMBODIMENTS

The description of the following embodiment(s) is exemplary in nature and is not intended to limit the claimed invention, its application, or its uses.

The bismuth or bismuth and graphitized carbon containing lubricant of this invention was developed for the forming of sheet metal aluminum alloys into complex shapes such as automotive body panels. But the properties of this lubricant material make it useful with other alloys, in other high temperature forming processes, and with other forming tools.

Figure 1:
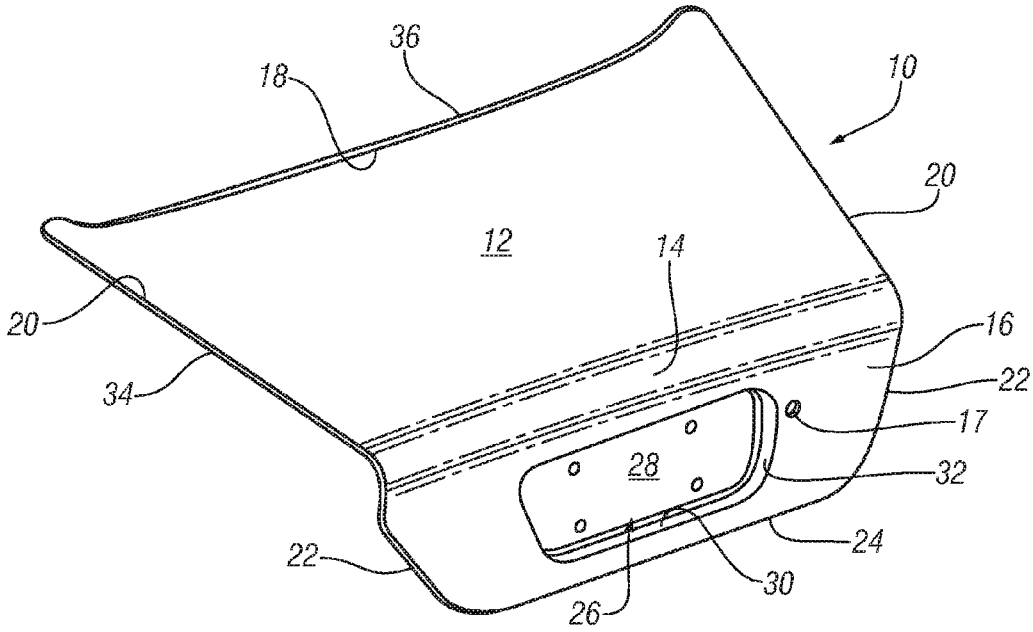
FIG. 1 shows an automobile decklid outer panel which is representative of a sheet metal part that may be formed in a high temperature sheet metal forming process in accordance with this invention.
Figure 2:
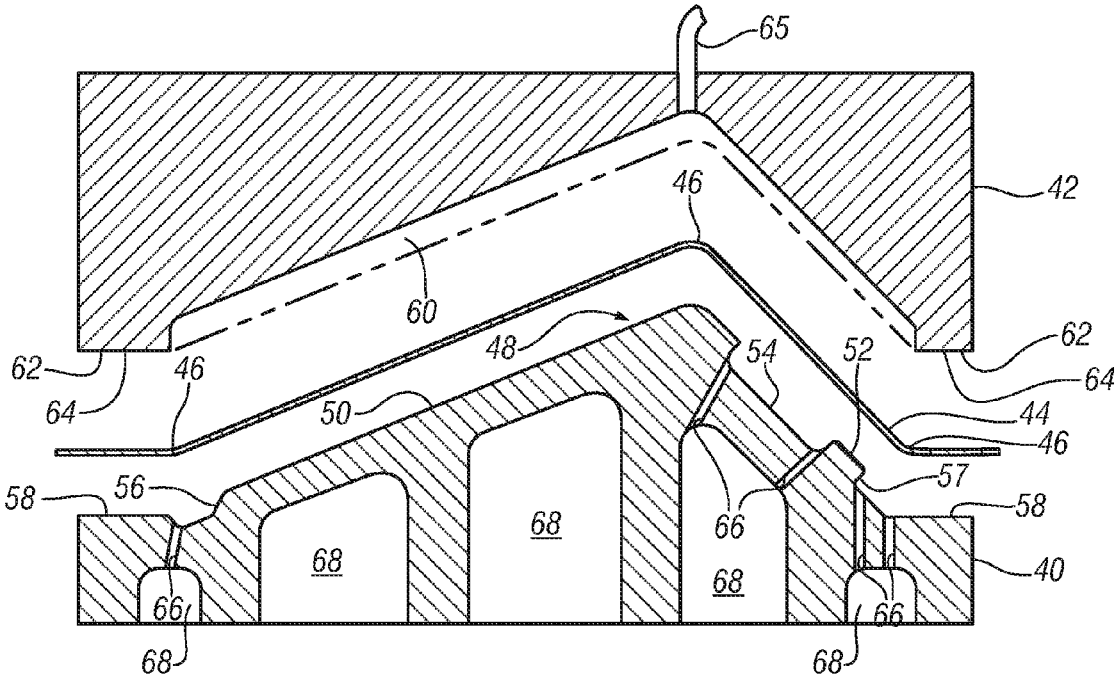
FIG. 2 is a cross-sectional view of upper and lower complementary tool members, with interposed metal sheet, for forming the decklid automobile outer panel of FIG. 1.
Figure 3:
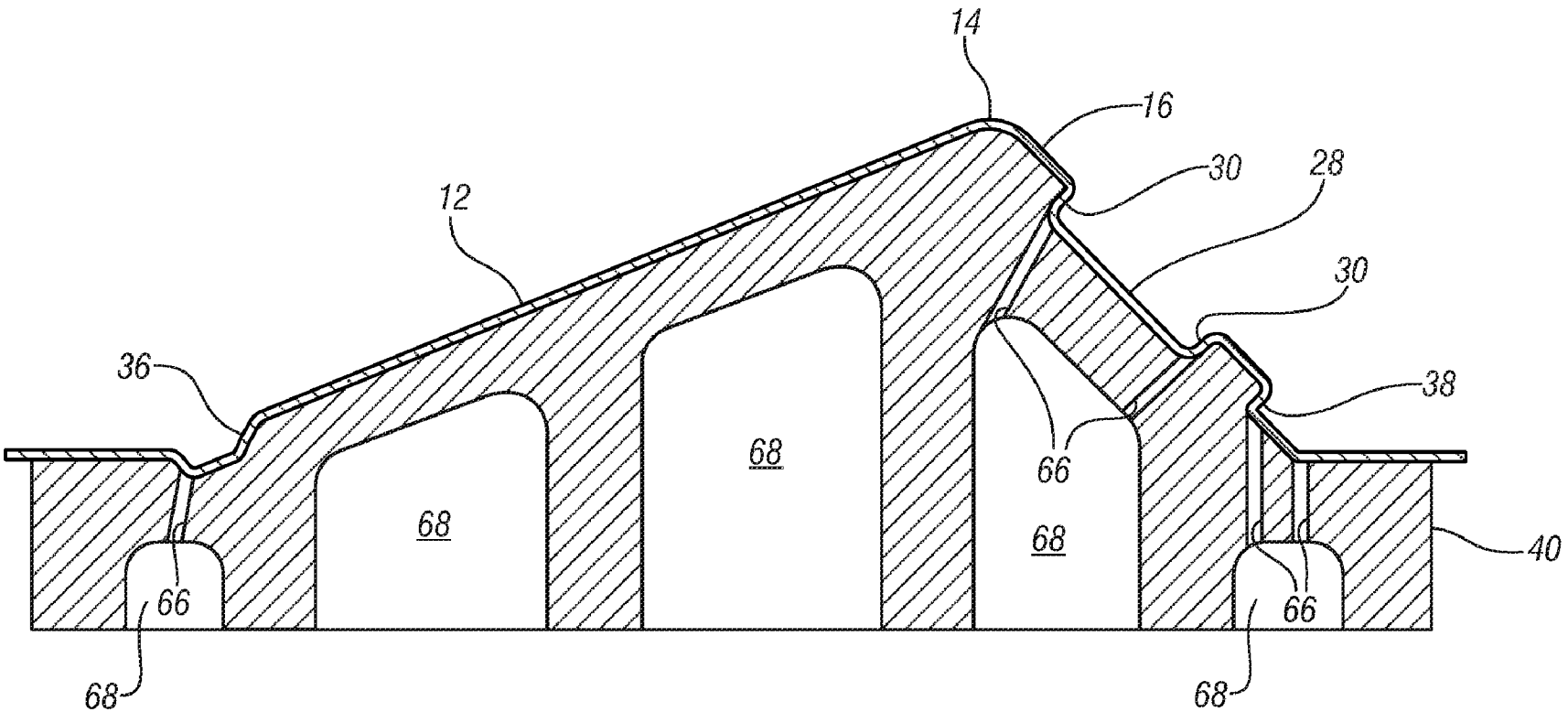
FIG. 3 is a cross-sectional view of the forming tool of FIG. 2 with a formed metal sheet.

FIG. 1 depicts an automobile decklid outer panel that may be formed by a hot stretch forming process as described below in this specification. And FIGS. 2 and 3 illustrate applicable hot stretch forming tooling which may be used to form the decklid panel using lubricating practices of this invention.

An automobile decklid outer panel 10 as shown in FIG. 1 defines part of a car body's rear and comprises a generally horizontal upper portion 12 that bends14 into a generally vertical portion 16. Decklid 10 is shaped to enclose the trunk compartment of the vehicle and to carry a latch and lock with pierced keyhole 17 and often a license plate.

Horizontal portion 12 has a forward edge 18 that is adapted to be fixed to the car body usually below the rear window and side edges 20 that fit close to the rear fender regions of the car body. Vertical portion 16 also has three edges. Side edges 22 fit close to the car body, usually between the rear stop lights, and bottom edge 24 fits close to the body near the bumper level of the vehicle.

The decklid 10 is of a complex curvature, both across the width of the decklid and across the length of its horizontal surface and down its vertical surface. Recessed region 26 includes flat portion 28 with four very steep walls. Two side walls 30 and 32 are seen in the generally perspective view of FIG. 1. In addition to the recessed portion 26, the decklid is also formed with flanges 34 (one shown in FIG. 1) at side edges 20 of the horizontal portion 12 and a panel break 36 at the rear edge 18 of horizontal portion 12. Bottom edge 24 also has a flange 38 as seen in FIG. 3. The bend 14, the severe angles of flanges 34 and 38, the steep walls 30 and 32, and the flat bottom 28 of recessed portion 26 of the decklid 10 require high elongation of the sheet metal.

FIG. 2 illustrates a forming tool comprising a lower tool member 40 and an upper tool member 42 for forming a heated metal sheet 44 into the decklid 10 shown in FIG. 1. Forming tool may be formed of a castable tool steel composition and the tool is typically machined from a block of the tool steel.

The metal sheet 44 may comprise any material capable of exhibiting high elongation under appropriate conditions, such as, (but not limited to) a very fine grain size, high processing temperatures, and a controlled strain rate. Examples of suitable materials include aluminum and titanium alloys. In one embodiment, the metal sheet 44 may be aluminum alloy 5083, which has a nominal composition by weight of about 4% to 5% magnesium, about 0.3% to 1% manganese, up to about 0.25% chromium, and the balance aluminum and low level alloying elements and impurities. The 5083 aluminum alloy may have a fine grain structure in the range of about five to thirty micrometers, and be processed to a thickness of about one to four millimeters. The forming temperatures and strain rates of a 5083 aluminum alloy sheet may vary depending on the type of process. For example, in one embodiment, a SPF process may provide that a 5083 aluminum alloy sheet be heated to a forming temperature in the range of 490° C. to 560° C. and subjected to a strain rate in the range of 10-4 s-1 to 10-3 s-1. In another embodiment, a QPF process may provide that a 5083 aluminum alloy sheet be heated to a forming temperature in the range of 400° C. to 510° C. and subjected to a strain rate greater than 10-3 s-1.

The lower tool member 40 comprises a complex forming surface 48 that defines the back side of the one-piece decklid 10. The forming surface 48 includes a forming portion 50 that defines the horizontal portion 12 of the decklid 10. Another portion 52 of the forming surface 48 forms the vertical portion of the decklid 10. Still another portion 54 forms the license plate recess 26. Other portions 56 and 57 form flanges at the forward edge of the decklid's 10 horizontal portion 12 and at the bottom of the decklid's 10 vertical portion 16. The periphery 58 of lower tool member 40 is adapted to sealingly engage the lower peripheral portion of the metal sheet 44. The lower tool member 40 may be hollowed out in regions 68 to reduce its mass and to facilitate machining of a plurality of passageways 66 to allow a working gas to be introduced into or vented from below the metal sheet 44. A working gas may need to be vented from below the blank 44 so that it can be shaped into strict conformance with the forming surface 48 of the lower tool member 40.

The upper tool member 42 is complementary in shape to the lower tool member 40 and is provided with a shallow cavity 60 for the introduction of a high pressure working against one side of the metal sheet 44. Examples of a suitable high pressure working gas include, but are not limited to, air, nitrogen, and argon. The periphery 62 of the upper tool member 42 is adapted to sealingly engage the upper peripheral portion of the metal sheet to prevent the escape of high pressure working gas. The upper tool member 42 also includes a passageway 65 to allow a high pressure working gas to be introduced into or vented from the shallow cavity 60. Preferably, forming tool is provided with internal electrical resistance heating cartridges (not shown) to heat both tool members 40, 42 to predetermined forming temperatures.

In one embodiment, the metal sheet 44 may be heated to its forming temperature prior to entering the forming tool. For example, the formable metal sheet 44 may be heated in an oven, or it may be heated in a first tool (not shown) that heats the formable metal sheet 44 and also initiates formation through preliminary and simple bending. FIG. 2 depicts a metal sheet 44 that experienced preliminary bending prior to introduction into the forming tool. A flat or bent metal sheet 44 may then be positioned between the opened upper tool member 42 and lower tool member 40. Once the metal sheet 44 is in position, the upper tool member 42 engages the upper peripheral portion of the metal sheet 44 and the lower tool member 40 engages the lower peripheral portion of the metal sheet 44. Passageways 66 in the lower tool member 40 may expel air or gas from below the metal sheet 44 so that the periphery of the metal sheet 44 is tightly clamped between the upper tool member 42 and the lower tool member 40. In another embodiment, the metal sheet 44 may be heated fully or partially by internally heated lower tool member 40 and upper tool member 42 as they are slowly closed on sheet 44. It is well known in the art that electrical resistance heating means may be embedded in the tooling to maintain the tooling at predetermined operating temperatures. Heating of the metal sheet 44 by the forming tool may occur before or after the metal sheet 44 has been engaged by the upper tool member 42 and the lower tool member 40.

Once the metal sheet 44 has been positioned, clamped, and attained it's forming temperature, a working gas may be introduced into cavity 60 through passageway 65 located in the upper tool member 42. The working gas pressure gradually forces the formable metal sheet 44 downward and into conformance with the forming surface 48 of the lower tool member 40 at controlled strain rates applicable to SPF and QPF processes. The working gas pressure may be continually increased in accordance with a pressurizing schedule, which may depend on the type of material used as a metal sheet, the structural complexity of the deformed metal workpiece, or the type of process being utilized (SPF or QPF).

FIG. 3 shows a resulting deformed metal workpiece after a metal sheet 44 has been subjected to a QPF or SPF high temperature sheet metal forming process. The surface of metal sheet 44 has been shaped into a deformed metal workpiece about the forming surface 48 of the lower tool member 40. In FIG. 3, the deformed metal workpiece is the decklid 10 described above.

At the completion of the forming operation, the upper tool member 42 may be separated from engagement with the upper surface of the deformed metal workpiece. The deformed metal workpiece may then be removed from the lower tool member 40 by separating the lower surface of the final workpiece from engagement with forming surface 48 of the lower tool member 40 and the peripheral portions of the lower tool member 40. A new metal sheet 44 may be introduced into the forming tool, thus restarting the process. The lubricants used in the forming process, discussed above, may also serve to assist in the release of the deformed metal workpiece from the tooling surfaces, such as the forming surface 48, and the peripheries 58, 62 of the tool members 40, 42.

In one embodiment of the invention, a lubricant comprising bismuth may be used with a high temperature sheet metal forming process. The lubricant may be applied to a first side of a metal sheet, which is usually the side that contacts the forming surface of the forming tool. The metal sheet is then heated to a forming temperature that depends on the composition of the metal sheet and on the type of high temperature sheet metal forming process being performed. For example, a forming temperature of 400° C. to 510° C. is suggested to deform aluminum alloy 5083 metal sheet under QPF process conditions. In the warm forming of sheet metal workpieces the metal temperature may be as low as about 200 oC.

Depending upon the forming temperature in a specific application, bismuth may melt and provide liquid phase lubrication for metal sheets used in high temperature sheet metal forming methods. At atmospheric pressure, bismuth melts at roughly 272° C. Thus, at the forming temperatures of many high temperature sheet metal forming methods (greater than 350° C.), bismuth will be a stable liquid capable of reducing adverse interactions between the metal sheet and the process tooling. After the metal sheet is lubricated and heated to an appropriate forming temperature, the metal sheet is deformed into a desired configuration by a high temperature sheet metal forming process as discussed above.

In order to apply bismuth to the metal sheet, the lubricant may comprise a bismuth precursor material suspended in a liquid medium. In one embodiment, the bismuth precursor may be bismuth subsalicylate (HOC6H4COOBiO). Bismuth subsalicylate is suitably suspended in water at, for example, 30 to 40 milligrams per milliliter of suspension to form a material that is readily applied to a sheet metal surface and dried to form an adherent lubricant film. Preferably boron nitride particles are also suspended with the bismuth precursor to form a mixture of the two materials as lubricants on the workpiece or tool surface(s).

Bismuth subsalicylate is a suitable bismuth precursor because it breaks down into bismuth and graphitized carbon at the forming temperatures of high temperature sheet metal forming methods. In addition to bismuth as discussed above, graphitized carbon also aids in protecting the surfaces of the metal sheet and the process tooling against friction and adhesion. The liquid medium may be selected so that it will evaporate at ambient temperatures or upon heating during high temperature sheet metal forming process. Examples of liquid mediums that will evaporate at ambient and above-ambient temperatures include, but are not limited to, water, alcohols, and ketones.

Upon evaporation of the liquid medium, a filmy residue of Bi and graphitize carbon remains. This filmy residue provides suitable lubrication because the Bi and graphitized carbon retain their desired lubricant properties at high forming temperatures. After the high temperature sheet metal forming process has been completed and the deformed metal workpiece has been removed from the process tooling, the residue may be readily removed using soap and water.

In addition to bismuth or a bismuth precursor, the lubricant may also comprise other lubricants if necessary. For example, boron nitride is a slippery, relatively low friction lubricant may be useful because it is stable at temperatures of up to 1000° C. in air, has a high thermal conductivity, and is fairly chemically inert. In one embodiment of the invention, the lubricant may comprise approximately equal parts by weight of bismuth subsalicylate and boron nitride (BN) suspended in water or other suitable liquid medium. The proportions of bismuth precursor and boron nitride are based on experience to achieve a desired lubricity in a given forming operation. The total weight of lubricants suspended in the liquid is typically based on the desired viscosity and flow-ability of the suspension as it is applied to workpieces and/or tools. After application the wet material is usually dried to form an adherent coating on the workpiece or tool.

The lubricant may be applied to various surfaces such as, but not limited to, high temperature sheet metal forming process tooling, the metal sheet, or both. For example, referring back to FIG. 2, the lubricant may be applied to the lower surface or the upper surface of the metal sheet 44. The lubricant may also be applied to the lower tool member 40, for example, the forming surface 48 and the peripheral portion 58 where engagement with the metal sheet 44 occurs. Likewise, the lubricant may be applied to the upper tool member 42, for example, the peripheral portion 62 where engagement with the metal 44 sheet occurs.

While exemplary embodiments of the disclosure have been described above, it will be recognized and understood that various modifications can be made by those of ordinary skill in the art. The appended claims are intended to cover all such modifications which may fall within the spirit and scope of the invention.

The invention claimed is:

1. A method of forming sheet metal alloys at elevated temperatures, the method comprising:

suspending particles of bismuth subsalicylate in a liquid;

applying a coating of the suspension to at least a first side of a metal alloy sheet, the sheet having an opposing side;

heating the metal alloy sheet with the bismuth subsalicylate particles coating to a forming temperature, the bismuth subsalicylate decomposing to a lubricant comprising bismuth prior to or during forming of the metal alloy sheet; and forming the sheet into a desired configuration by stretching the first side of the sheet with the lubricant into conformance with a heated forming surface of a forming tool.

2. The method as set forth in claim 1 further comprising:

providing an internally heated forming tool comprising a forming surface at a forming temperature for an aluminum alloy workpiece;

providing an aluminum alloy sheet metal workpiece having a first surface for engagement with the forming surface of the forming tool;

applying a coating of the suspension of particles of bismuth subsalicylate as a lubricant coating to a least one of the forming surface of the forming tool and the first surface of the aluminum alloy sheet metal workpiece; and forming the sheet into the desired configuration by applying a pressurized working gas to the opposing surface of the sheet metal workpiece, the bismuth-containing lubricant acting between the first surface of the metal sheet and the forming surface of the tool.

3. The method as set forth in claim 1 wherein the bismuth-containing lubricant comprises bismuth and graphitized carbon.

4. The method as set forth in claim 1 wherein the bismuth subsaliclyate is suspended in a liquid comprising at least one of water, an alcohol, or a ketone.

5. The method as set forth in claim 1 wherein application of the bismuth subsalicylate coating comprises spraying a liquid suspension comprising bismuth subsalicylate.

6. The method as set forth in claim 1 wherein the forming temperature is in excess of 200° C.

7. The method as set forth in claim 1 wherein bismuth subsalicylate coating further comprises boron nitride.

8. The method as set forth in claim 1 wherein the sheet metal alloy is an aluminum alloy and the coating of the suspension is applied to at least the first side of an aluminum alloy sheet.

* * * * *